US006318226B1

(12) United States Patent
Swedberg

(10) Patent No.: US 6,318,226 B1
(45) Date of Patent: Nov. 20, 2001

(54) AMMUNITION RELOADER PRESS WAD CUTTER

(76) Inventor: Jeffrey D. Swedberg, P.O. Box 455, Plains, MT (US) 59859

( * ) Notice: Subject to any disclaimer, the term of this patent is extended or adjusted under 35 U.S.C. 154(b) by 0 days.

(21) Appl. No.: 09/154,607

(22) Filed: Sep. 16, 1998

Related U.S. Application Data

(60) Provisional application No. 60/059,156, filed on Sep. 17, 1997.

(51) Int. Cl.[7] ..... F42B 33/00

(52) U.S. Cl. ..... 86/23; 86/24; 86/1.1; 83/164

(58) Field of Search ..... 86/23, 1.1, 24, 86/44, 25; 83/164, 690

(56) References Cited

U.S. PATENT DOCUMENTS

| | | | | |
|---|---|---|---|---|
| 290,230 | | 12/1883 | Haviland et al. . | |
| 2,061,576 | * | 11/1936 | Huyett | 86/23 |
| 2,654,140 | | 1/1953 | Gibbs | 29/1.23 |
| 2,960,903 | | 11/1960 | Scott | 85/23 |
| 2,995,058 | * | 8/1961 | Reiner | 86/23 |
| 3,143,919 | | 8/1964 | Estes | 86/23 |
| 3,376,781 | | 4/1968 | Swanson | 86/25 |
| 4,267,753 | * | 5/1981 | Bennett | 83/124 |
| 4,887,509 | | 12/1989 | Hodulik | 83/36 |
| 5,042,352 | * | 8/1991 | Lux | 83/690 |
| 5,202,529 | * | 4/1993 | Shields | 86/23 |

* cited by examiner

*Primary Examiner*—Peter M. Poon
*Assistant Examiner*—Son T. Nguyen

(57) ABSTRACT

A device for cutting wads used to reload ammunition. The device is used with an ammunition reloader press and comprises an anvil that threadably attaches to the head of a reloading press, a punch that attaches to a cartridge casing holder connected to the ram of the reloading press, and a guide that threadably engages the anvil and guides the punch into the anvil when the ram is moved toward the head of the reloader press. The anvil and guide have aligned axial bores which receive the punch. The bore of the anvil has a smaller diameter portion with a cutting edge, and a larger diameter portion which retains the cut wads. The guide has a slot for receiving wad material. The slot extends transversely through the guide and intersects the internal bore of the guide. One end of the punch has a sloped cutting face with a peripheral edge which acts with the anvil cutting edge to cut wad material. The punch has a feature, such as an annular ring, at the other end which engages a typical cartridge casing holder to attach the punch to the ram of the reloading press.

19 Claims, 5 Drawing Sheets

AMMUNITION RELOADER PRESS WAD CUTTER

CROSS-REFERENCE TO RELATED APPLICATIONS, IF ANY

This application claims the benefit, under 35 USC. 119(e), of U.S. provisional application Ser. No. 60/059,156, filed Sep. 17, 1997, pending.

STATEMENT REGARDING FEDERALLY SPONSORED RESEARCH OR DEVELOPMENT

Not applicable.

REFERENCE TO A MICROFICHE APPENDIX IF ANY

Not Applicable.

BACKGROUND OF THE INVENTION

1. Field of the Invention

This invention relates generally to ammunition reloader tools and, more particularly, to black powder metallic cartridge reloading tools.

2. Background Information

Those who engage in black powder shooting typically reload their own cartridges. In the reloading process, each cartridge may have a wad or disk installed between the powder and the bullet. At the present time, there is no convenient means by which black powder metallic or paperboard cartridge wads can be produced with the accuracy and consistency desired. Black powder shooters will often have a reloading press available for reloading their own cartridges. However, these reloading presses are not presently suited to aid the shooter in making the necessary cartridge wads.

Applicant's invention provides a device for cutting wads with a reloading press which overcomes the limitations and shortcomings of the prior art.

BRIEF SUMMARY OF THE INVENTION

A device for cutting wads used to reload ammunition is used with an ammunition reloader press and comprises an anvil that threadably attaches to the head of a reloading press, a punch that attaches to a cartridge casing holder connected to the ram of the reloading press or directly to the ram, and a guide that threadably engages the anvil and guides the punch into the anvil when the ram is moved toward the head of the reloader press. The anvil and guide have aligned axial bores which receive the punch. The bore of the anvil has a smaller diameter portion with a cutting edge, and a larger diameter portion which retains the cut wads. The guide has a slot for receiving wad material. The slot extends transversely through the guide and intersects the internal bore of the guide. One end of the punch has a sloped cutting face with a peripheral edge which acts with the anvil cutting edge to cut wad material. The punch has a feature, such as an annular ring, at the other end which engages a typical cartridge casing holder to attach the punch to the ram of the reloading press.

A primary object of this invention is to provide means by which ammunition reloading tools can be adapted to cut black powder paperboard or other type of cartridge wads. Another object is to provide a black powder metallic cartridge wad cutting kit that can be installed on conventional ammunition reloading tools. A further object is to provide such a wad cutting kit that can be installed on conventional ammunition reloading presses without modification of the reloading press. The features, benefits and objects of this invention will become clear to those skilled in the art by reference to the following description, claims and drawings.

DETAILED DESCRIPTION

Figure 1:
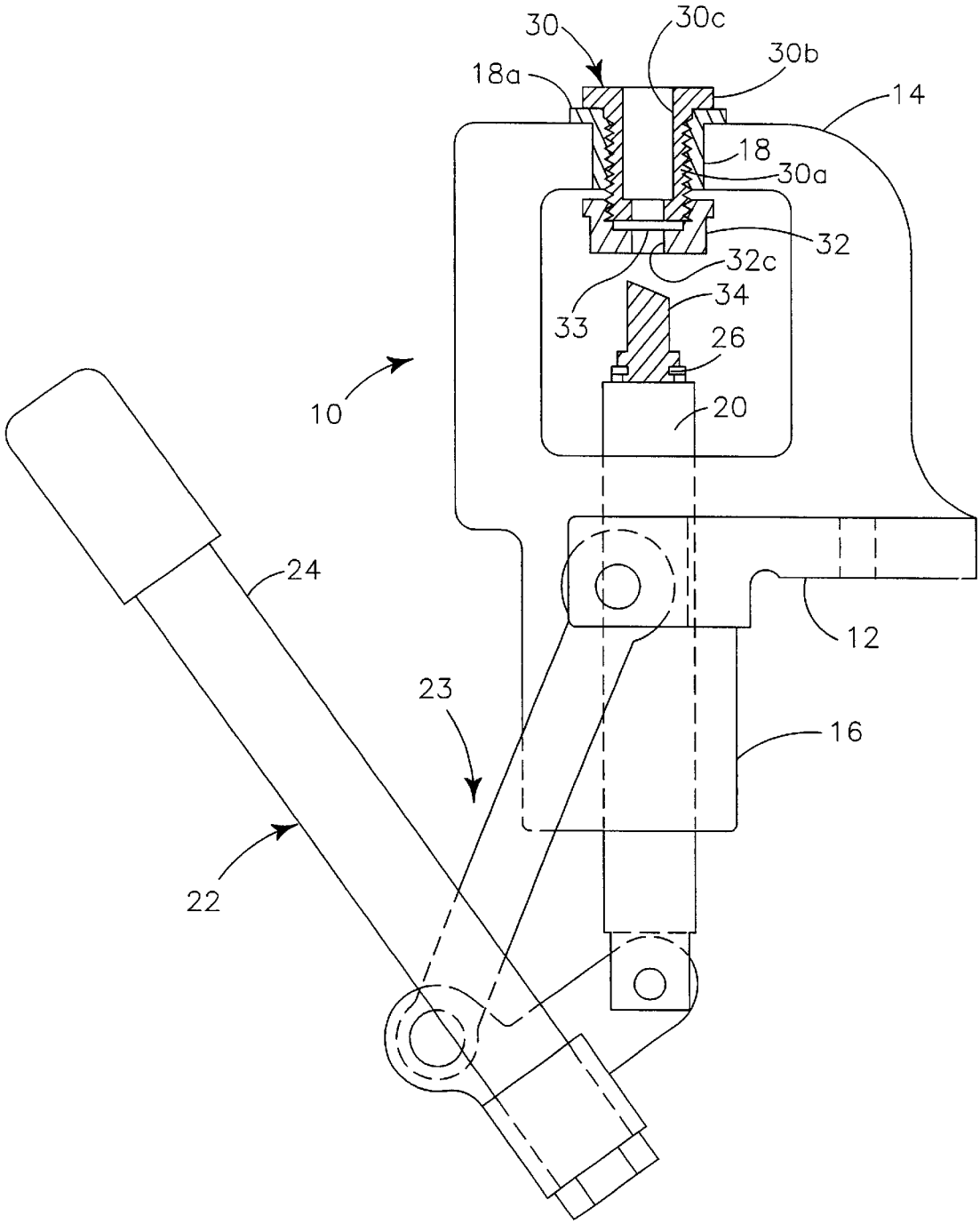
FIG. 1 is a elevation view of a typical bench-type cartridge reloading press with one embodiment of the wad cutting kit of the present invention installed, the elements of the wad cutting kit being shown in cross-section.
Figure 2:
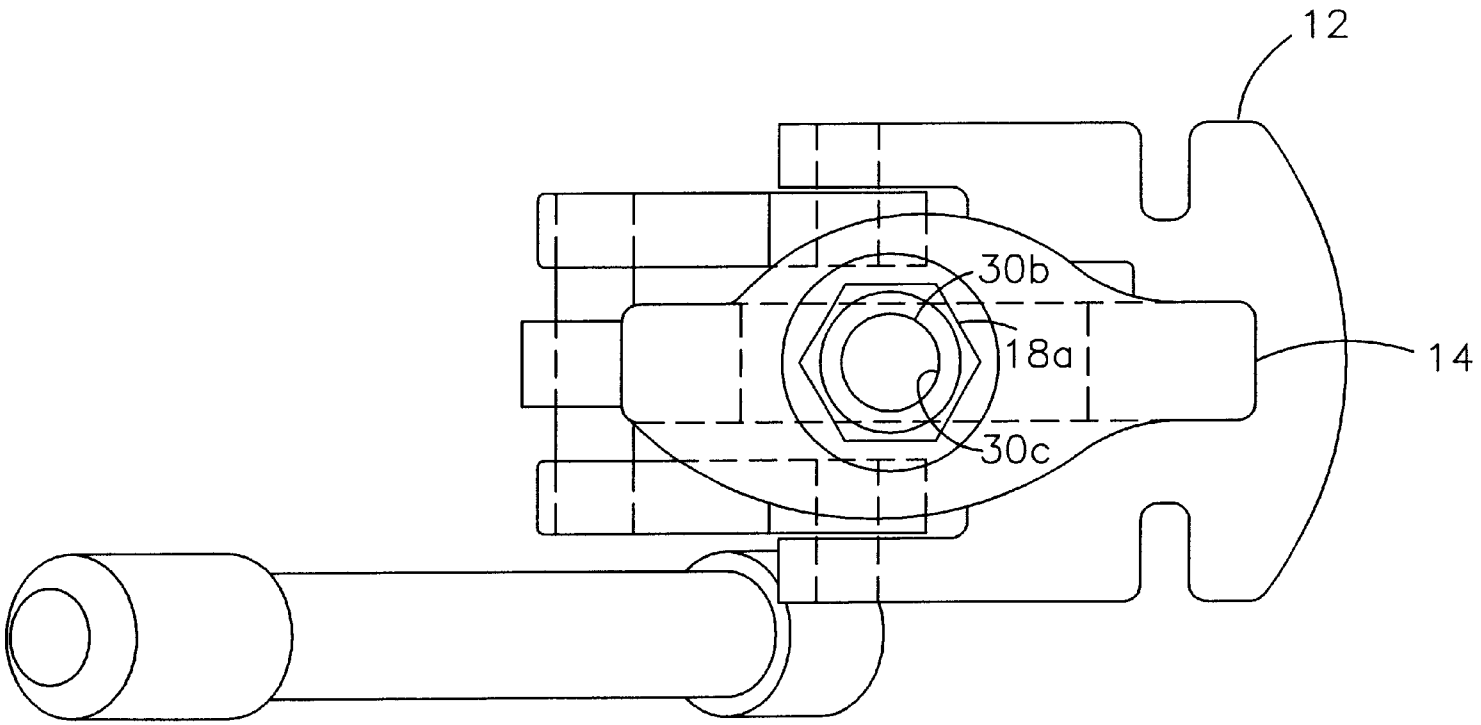
FIG. 2 is a top plan view of the press of FIG. 1.
Figure 7:
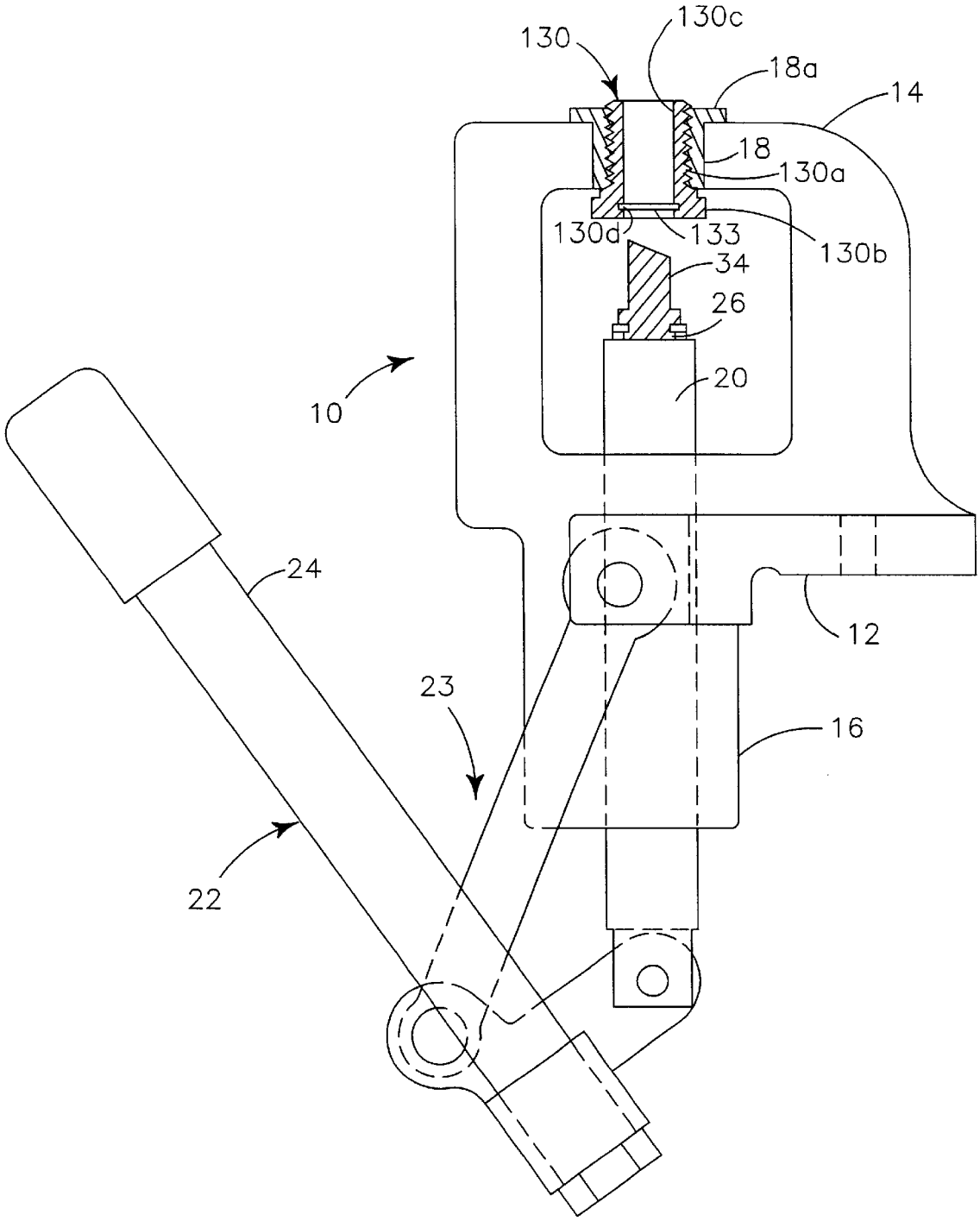
FIG. 7 is an elevation view of a typical bench-type cartridge reloading press with another embodiment of the wad cutting kit of the present invention installed, the elements of the wad cutting kit being shown in cross-section.
Figure 8:
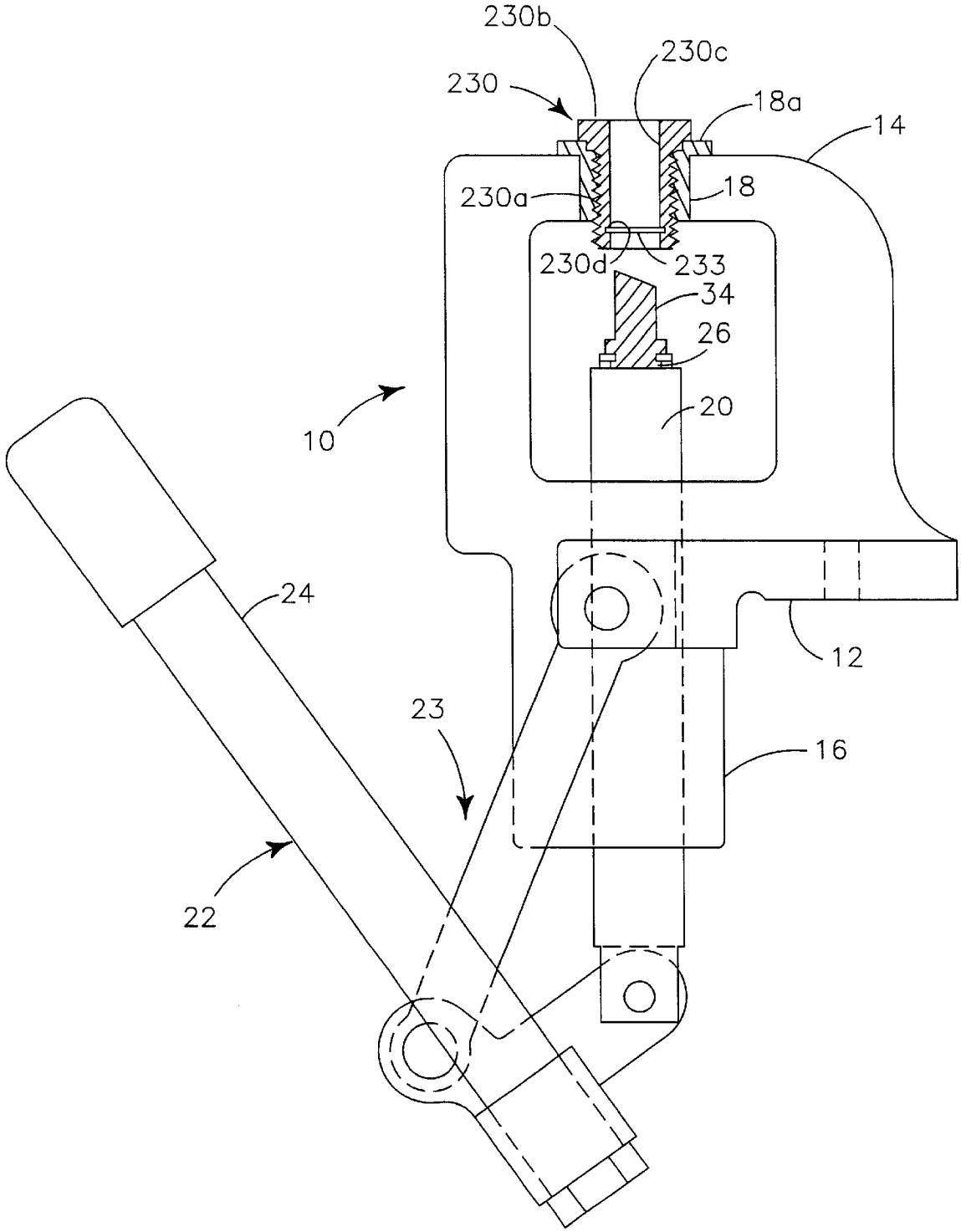
FIG. 8 is an elevation view of a typical bench-type cartridge reloading press with a third embodiment of the wad cutting kit of the present invention installed, the elements of the wad cutting kit being shown in cross-section.

Referring to FIGS. 1, 7 and 8, a typical bench mounted reloading press tool 10 can be fitted with the wad cutting kit of this invention. A typical reloading press comprises a bench mounting base 12 upon which a head 14 and a ram guide 16 are provided. The base, head and ram guide are commonly part of a one-piece metal casting. The head 14 has a threaded bore 18 at the top for mounting a die body, threaded bore 18 being typically provided by a machined and internally-threaded insert 18*a* that is fitted into the upper arm of the casting. The ram guide 16 has a vertical bore for receiving a cylindrical ram 20. A ram actuating mechanism 22 is fastened to the casting, comprising a linkage 23 that can be actuated by a lever handle 24 so as to enable an operator to raise and lower the rain 20 during a reloading operation. The top of the ram is generally provided with a cartridge casing holder 26, typically called a "shell holder" into which the base of a shell casing can be positioned to hold the casing in a proper location for reforming and loading during the reloading operation. Various casing forming dies and bullet setting dies are designed to be inserted into the head bore 18 for use in forming and loading a cartridge casing held by the shell holder 26. The reloading press illustrated is similar to presses manufactured by Lyman Products Corporation of Middlefield, Connecticut.

Referring to FIGS. 1–6 and FIG. 9, the wad cutting kit of the present invention comprises an anvil 30, a guide 32, and a punch 34. Anvil 30 is designed to be carried in the head bore 18, a guide 32 is designed to be carried by the anvil 30, and a punch 34 is designed to be carried by the shell holder 26. The anvil provides a cutting edge 30*d* used to shear cartridge wads 40 from a supply strip of wad material (not shown). The guide provides a slot 33 through which a supply strip of wad material may be moved during a wad-cutting operation. The guide also guides the punch 34 into the anvil 30 and through the supply strip of wad material so that coaction between the anvil cutting edge 30*d* and the punch peripheral edge 34*c* can produce cartridge wads from the supply strip.

Figure 3:
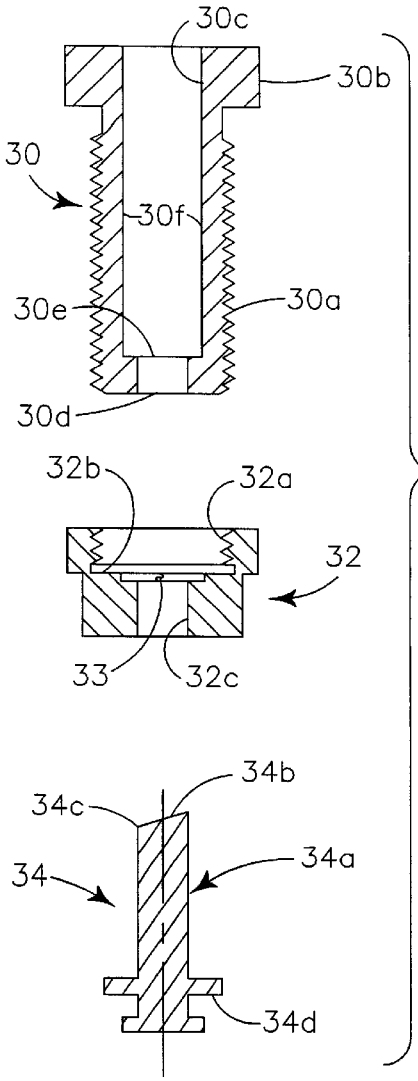
FIG. 3 is an exploded view of the FIG. 1 wad cutting kit elements illustrating the threaded anvil at the top, the guide in the middle, and the punch at the bottom.
Figure 6:
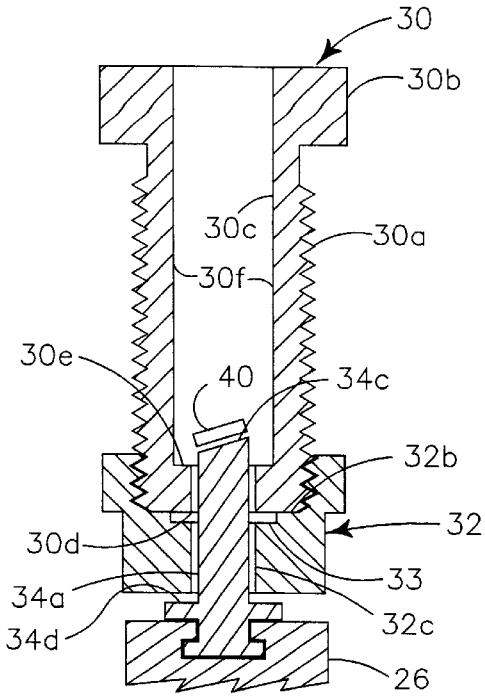
FIG. 6 is an enlarged view of the wad cutting kit elements of FIG. 1.
Figure 4:
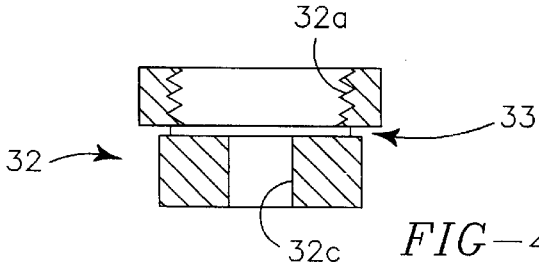
FIG. 4 is a side view of the guide element of FIG. 3.

Referring to FIGS. 3 and 6, anvil 30 comprises an externally threaded shaft 30*a* having a circular cap, or head 30*b*. The anvil is bored to provide an internal axial bore 30*c* that extends longitudinally and axially through the shaft 30*a* and the cap 30*b*. Anvil 30 has a diameter and thread designed to mate with the threaded bore 18 of a particular reloading press, and its diameter, thread and length may be varied to accommodate any particular press configuration. As shown in FIG. 1, anvil 30 can be screwed in the thread bore 18 to the point where cap 30*b* rests on top of the press head's machined insert 18*a*. The shaft 30*a* extends through the head bore 18 so that it protrudes below the head 14.

Referring to FIGS. 3–6, guide 32 comprises a collar that has an upper internally-threaded counter-bore 32*a* so that guide 32 can be screwed onto the lower end of the anvil shaft 30*a* after anvil 30 has been installed in the head bore 18. The counter-bore 32*a* provides an internal shoulder 32*b* against which the lower end of the anvil shaft 30*a* can seat when guide 32 is screwed onto the anvil lower end. The portion of guide 32 that contains counter bore 32*a* may be enlarged as shown, but the portion below counter bore 32*a* need not be so large. The guide 32 is bored to provide an internal axial guide bore 32*c* that extends longitudinally through the guide from its lower end to the counter-bore 32*a*. Bore 32*c* serves as a guide passage for an elongated cylindrically-configured shaft of the punch 34. When guide 32 is screwed onto the anvil 30 so that shoulder 32*b* seats against the end of the anvil lower end, the lower circular inner edge 30*d* of anvil bore 30*c* acts as the cutting edge for cutting circular wads. Guide 32 is provided with a diametrical slot 33 transversely through the body of guide 32, just below the shoulder 32*b*. Slot 33 has a width slightly greater than the diameter of the guide bore 32. Slot 33 has a height and width sufficient to accept a strip of wad material of a particular thickness and width, the strip of wad material being inserted into one end of the slot 33 and removed from the opposite end.

Figure 9:
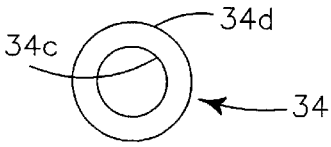
FIG. 9 is a top view of the punch element of FIG. 3.
Figure 5:
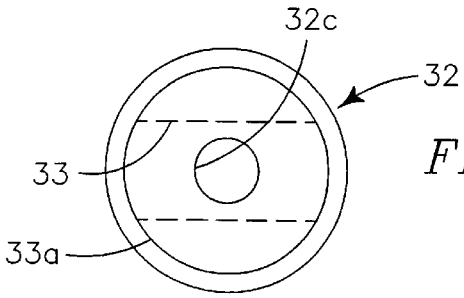
FIG. 5 is a top view of the guide element of FIG. 3.

Referring to FIGS. 3, 6, and 9, punch 34 comprises an elongated punch shaft 34*a* configured to be extended longitudinally through the guide bore 32*c* and into the anvil bore 30*c*. Shaft 34*a* has a slip-fit tolerance with the guide bore 32*c*. The upper end of shaft 34*a* is tapered so as to provide a sloped cutting face 34*b* with an elliptical peripheral cutting edge 34*c* that will act with the anvil cutting edge 30*d* so as to shear circular wads from a strip of wad material. The lower end 34*d* of punch 34 is formed to be held by the shell holder 26 of the press. In the particular press 10 shown in FIG. 1, the shell holder 26 is designed to receive an annularly-grooved cartridge shell base. The lower end 34*d* of punch 34, for this type of press, is configured to replicate the external configuration of the annularly-grooved cartridge shell base so that it can be positioned in and retained by the shell holder 26 of the press. Punch 34 is raised and lowered by the press actuating mechanism 22. If desired, an additional element could be provided in the wad-cutting kit that could replace the tool's shell holder so that some other external configuration could be provided for the lower end 34*d* of the punch 34; in which case the additional element would be installed on top of the tool's ram 20 in place of the shell holder 26 for the purpose of receiving and holding the punch 34.

When a strip of wad material, either metal or paperboard, is inserted through the slot 33 in the guide 32, the coaction of the upwardly moving punch 34 and its peripheral cutting edge 34*c* on its sloped cutting face 34*b* with the anvil cutting edge 30*d* will shear a circular wad 40 from the wad strip. After shearing one circular wad from the wad strip, the punch 34 may be lowered below the slot 33 so that the wad strip can be shifted to present an uncut portion across the guide bore 32*c*. Then, the punch 34 can be moved upward so as to shear another wad from wad strip. The previously-sheared circular wad may be first removed before the subsequent shearing of another wad, or the previously-sheared wad may be left upstream of the guide bore 32*c*, within the anvil bore 30*c*. The anvil bore 30*c* may be enlarged above the anvil cutting edge 30*d* so as to provide an inner shoulder 30*e*, above which the bore 30*c* provides a larger diameter passage 30*f* into which sheared circular wads may be collected. As seen in FIG. 6, the punch 34 has been extended through the guide bore 32*c* so that the cutting edge 34*c* on the punch cutting face 34*b* has passed through the slot 33, thereby shearing a circular wad 40 from a wad strip. When punch 34 is withdrawn, downwardly, the wad 40 may be left within the enlarged passage 30*f* of the anvil 30 for removal later. When the wad 40 is sheared from a strip of material, it may expand slightly after it is moved into the position shown in FIG. 6 so that it will be retained above the shoulder 30*e*.

Referring to FIG. 7, in this alternate embodiment the anvil of FIGS. 1–6 is inverted and combines the guide into the anvil. In this embodiment, the anvil 130 has its head or cap 130*b* below the anvil threaded shaft 130*a* and the wad guide slot 133 is provided in the cap 130*b*. Guide slot 133 extends diametrically through the cap 130*b*. In this embodiment, the width of slot 133 is slightly greater than the diameter of the internal axial bore 130*c* of the anvil 130. The anvil bore 130*c* may be countered-bored so as to provide features similar to shoulder 30*e* and enlarged passage 30*f* of FIGS. 3 and 6. The anvil cutting edge 130*d* is provided by the upper edge of anvil bore 130*c* where it intersects the top of slot 133.

Referring to FIG. 8, another embodiment is slightly different in that the anvil and guide of FIGS. 1–6 are combined into one unitary element. In this embodiment, the anvil 230 extends downward below the press head 14 a sufficient distance such that the wad guide slot 233 provided in the lower end of the anvil threaded shaft 230*a* is below head 14 of the reloading press 10. This embodiment is less complicated in that the anvil and guide functions are provided in a single element. However, the manufacture of that single element so as to provide the slot 233 through the threaded shaft 230*a* might be more complicated. Guide slot 233 extends diametrically through the lower portion of the threaded shaft 230*a* . In this embodiment, the width of slot 233 is slightly greater than the diameter of the internal axial bore 230*c* of the anvil 230. The anvil bore 230*c* may be counter-bored so as to provide features similar to shoulder 30*e* and enlarged passage 30*f* of FIGS. 3 and 6. The anvil cutting edge 230*d* is provided by the upper edge of anvil bore 230*c* where it intersects the top slot 233.

The descriptions above and the accompanying drawings should be interpreted in the illustrative and not the limited sense. While the invention has been disclosed in connection with the preferred embodiment or embodiments thereof, it should be understood that there may be other embodiments which fall within the scope of the invention as defined by the following claims.

What is claimed is:

1. A wad cutting device for use with an ammunition reloader press, comprising:

(a) an anvil adapted to be attached to a first portion of a reloader press, the anvil having an internal bore;

(b) a aguide attached to the anvil, the guide having an internal bore for receiving a punch, the internal bore of the guide communicating with the internal bore of the anvil, the guide having a feature for receiving wad material; and (c) a pnch adapted to be attached to a second portion of a reloader press, the punch being movable along the internal bore of the guide and into the internal bore of the anvil when the first portion and second portion of the reloading press are moved relative to each other.

2. The device of claim 1, wherein the anvil has a first end and the internal bore of the anvil has an edge at the first end which acts as a cutting edge for cutting wads from wad material.

3. The device of claim 2, wherein the internal bore of anvil has a smaller diameter portion and a larger diameter portion axially adjacent to the smaller diameter portion, the smaller diameter portion extending axially from the cutting edge to the larger diameter portion.

4. The device of claim 2, wherein the punch is an elongated cylindrical shaft with a first end having a cutting face with a peripheral edge which acts with the anvil cutting edge to cut wad material.

5. The device of claim 4, wherein the punch has an axis, and the cutting face is not normal to that axis.

6. The device of claim 4, wherein the punch has a second end having an attachment feature for connecting the punch to the second portion of the reloading press.

7. The device of claim 6, wherein the attachment feature is an annular groove configured to engage a shell holder attached to the second portion of the reloading press.

8. The device of claim 1, wherein the anvil is cylindrical and has a first portion having external threads which engage internal threads in the first portion of the reloading press to connect the anvil to the reloading press.

9. The device of claim 8, wherein the anvil has a second portion extending axially from the first portion, the second portion having a larger diameter than the first portion, a shoulder being formed at the intersection of the first portion and the second portion, the shoulder contacting the first portion of the reloader press to limit travel of the anvil relative to the first portion of the reloader press as the anvil is screwed into the reloading press.

10. The device of claim 8, wherein the internal bore of the guide has a larger diameter portion with internal threads that engage the external threads of anvil.

11. The device of claim 10, wherein the internal bore of guide has smaller diameter portion axially adjacent to the larger diameter portion, with a shoulder at the juncture of the smaller diameter portion and the larger diameter portion, the shoulder engaging the anvil when the guide is screwed onto the anvil.

12. The device of claim 11, wherein the feature for receiving wad material is a slot aligned with the internal bore of the guide, the slot extending transversely through the guide and intersecting the smaller diameter portion of the internal bore adjacent to the shoulder.

13. The device of claim 12, wherein the slot has a width that is greater than the diameter of the smaller diameter portion of the internal bore of the guide and less than the diameter of the larger diameter portion of the internal bore of the guide.

14. The device of claim 1, wherein the feature for receiving wad material is a slot aligned with and intersecting the internal bore of the guide, the slot extending transversely through the guide.

15. The device of claim 14, wherein the slot has a width and height sufficient to accept a wad material of a particular width and thickness.

16. The device of claim 14, wherein the internal bore of the guide has a diameter and the slot has a width greater than that diameter.

17. The device of claim 1, wherein the anvil and the guide are a single unit.

18. A wad cutting device for use with an ammunition reloader press, comprising:

(a) and anvil adapted to be attached to a first portion of a reloader press, the anvil having a first end and an internal bore that has an edge at the first end which acts as a cutting edge for cutting wads from wad material;

(b) a guide attached to the anvil, the guide having an internal bore for receinving a punch, the internal bore of the guide communicating with the internal bore of the anvil, the internal bore of the guide having a portion that engages the anvil to connect the guide to the anvil, the guide having a slot for receiving wad material, the slot being aligned with and intersecting the internal bore of the guide; and (c) a punch adapted to be attached to a second portion of a reloader press, the punch being an elongated cylindrical shaft with a first end having a cutting face with a peripheral edge which acts with the anvil cutting edge to cut wad material, the punch being movable along the internal bore of the guide and into the internal bore of the anvil when the first portion and second portion of the reloading press are moved relative to each other.

19. A conversion kit for adapting a cartridge reloading press to produce cartridge wads the press including a first and second relatively moveable holder elements, one of the elements comprising a cartridge casing holder and the other of the elements comprising a die body holder, and a actuator mechanism therefor, the kit comprising:

an anvil adapted for attachment to the first holder element;

a wad material receiving structure mounted in operative association with the anvil;

said anvil including an internal bore and the wad receiving structure being constructed and arranged to position a supply of wads from the wad material to spam the bore; and a cutter adapted for attachment to the second holder element and engagable in the internal bore cutting wads from the wad material upon operation of the actuator mechanism.

* * * * *